US008088023B2

(12) United States Patent
Kubota

(10) Patent No.: US 8,088,023 B2
(45) **Date of Patent: *Jan. 3, 2012**

(54) IRON GOLF CLUB HEAD

(75) Inventor: Makoto Kubota, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/894,706

(22) Filed: Sep. 30, 2010

(65) Prior Publication Data

US 2011/0021290 A1 Jan. 27, 2011

Related U.S. Application Data

(62) Division of application No. 11/860,832, filed on Sep. 25, 2007, now Pat. No. 7,828,674.

(30) Foreign Application Priority Data

Oct. 6, 2006 (JP) ..... 2006-275160

(51) Int. Cl.
*A63B 53/04* (2006.01)

(52) U.S. Cl. ..... 473/335; 473/338; 473/349; 473/350

(58) Field of Classification Search ..... 473/324–350, 473/287–292
See application file for complete search history.

(56) References Cited

U.S. PATENT DOCUMENTS

| | | | | |
|---|---|---|---|---|
| 4,085,934 | A | 4/1978 | Churchward | |
| 4,340,230 | A | 7/1982 | Churchward | |
| 4,792,139 | A * | 12/1988 | Nagasaki et al. | 473/342 |
| 4,852,880 | A | 8/1989 | Kobayashi | |
| 5,050,879 | A | 9/1991 | Sun et al. | |
| 5,344,140 | A | 9/1994 | Anderson | |
| 6,030,293 | A | 2/2000 | Takeda | |
| 6,045,456 | A | 4/2000 | Best et al. | |
| 6,638,183 | B2 | 10/2003 | Takeda | |
| 6,773,361 | B1 | 8/2004 | Lee | |
| 6,921,344 | B2 | 7/2005 | Gilbert et al. | |
| 6,929,563 | B2 | 8/2005 | Nishitani | |
| 7,207,899 | B2 | 4/2007 | Imamoto | |
| 7,316,623 | B2 | 1/2008 | Imamoto | |
| 7,326,472 | B2 | 2/2008 | Shimazaki et al. | |
| 7,351,163 | B2 | 4/2008 | Shimazaki et al. | |
| 7,828,674 | B2 * | 11/2010 | Kubota | 473/335 |
| 2004/0043830 | A1 | 3/2004 | Imamoto | |
| 2005/0192116 | A1 | 9/2005 | Imamoto | |
| 2005/0197208 | A1 | 9/2005 | Imamoto | |

FOREIGN PATENT DOCUMENTS

JP 6-319836 A 11/1994

(Continued)

OTHER PUBLICATIONS

Japanese Office Action issued on Jul. 7, 2011 in the corresponding Japanese Patent Application No. 2006-275160.

*Primary Examiner* — Sebastiano Passaniti
(74) *Attorney, Agent, or Firm* — Sughrue Mion, PLLC

(57) ABSTRACT

An iron golf club head includes: a block that is made by a magnesium alloy; and a metal head main body, wherein the block is embedded into the metal head main body.

7 Claims, 6 Drawing Sheets

FOREIGN PATENT DOCUMENTS

| | | | |
|---|---|---|---|
| JP | 6-343722 | A | 12/1994 |
| JP | 8-126723 | A | 5/1996 |
| JP | 9-38249 | A | 2/1997 |
| JP | 9-140837 | A | 6/1997 |
| JP | 9-276455 | A | 10/1997 |
| JP | 11-151328 | A | 6/1999 |
| JP | 2000-79185 | A | 3/2000 |
| JP | 2000-84126 | A | 3/2000 |
| JP | 2000-157653 | A | 6/2000 |
| JP | 2000-210400 | A | 8/2000 |
| JP | 2002102399 | A | 4/2002 |
| JP | 2004-16737 | A | 1/2004 |
| JP | 2004-89434 | A | 3/2004 |
| JP | 2005-58765 | A | 3/2005 |
| JP | 2005-218510 | A | 8/2005 |
| JP | 2005-245519 | A | 9/2005 |
| JP | 2006-239154 | A | 9/2006 |
| JP | 2007083012 | A | 4/2007 |

* cited by examiner

IRON GOLF CLUB HEAD

CROSS REFERENCE TO RELATED APPLICATION

This is a divisional of application Ser. No. 11/860,832 filed Sep. 25, 2007, which claims priority to JP 2006-275160 filed Oct. 6, 2006. The entire disclosure of the prior application, application Ser. No. 11/860,832 is hereby incorporated by reference.

BACKGROUND OF THE INVENTION

1. Field of the Invention

The present invention relates to an iron golf club head which provides superior feeling of hitting and has a solid structure.

2. Description of the Related Art

An iron golf club head having a solid structure formed from a metal block which is free of a hollow section is available. This solid iron golf club head provides secure feeling of hitting and enables a golfer to securely feel a hit point. When the ball is hit without the meet of the club head, vibration shakes hands. For these reasons, the solid iron golf club head is called as being suited for high-grade golfers.

Meanwhile, an iron golf club head having a hollow structure, in which a hollow section is formed in a metal head, is also available. In this hollow iron golf club head, a hollow section is formed on the rear of a face of the head, and feeling of hitting achieved by this golf club head is evaluated as being poor. Therefore, in relation to the hollow iron golf club head, arranging a viscoelastic element into the hollow section; for instance, coating the rear side of the face of the head (a hollow-section-side surface of the head) with a thin film made of viscoelastic resin having a damping characteristic, has been proposed with a view toward enhancing feeling of hitting, as disclosed in JP-A-6-319836. The hollow iron golf club head having the viscoelastic element provided in the hollow section yields an advantage of vibration of the head being dampened at the time of hitting.

SUMMARY OF THE INVENTION

The above-described hollow iron golf club head having the viscoelastic element provided in the hollow section provides the feeling of hitting desirable for beginner golfers and middle-grade golfers. However, the high-grade golfers are provided with light feeling of hitting and light hitting sound, and hence do not prefer the hollow iron golf club head.

The present invention has been conceived under the circumstances and aims at providing an iron golf club head which provides desirable feeling of hitting and hitting sound to high-grade golfers as well as to beginner golfers and middle-grade golfers.

In order to achieve the object, the present invention provides an iron golf club head having a block of a magnesium alloy embedded in a metal head main body.

As a result of a block of a magnesium alloy being embedded in a metal head main body, the iron golf club head of the present invention has an advantage of a solid iron golf club head; namely, provision of secure feeling of hitting, and yields an effect of vibration of the head induced by hitting being dampened by the soft, light-weight block of a magnesium alloy. Therefore, the iron golf club head of the present invention can provide desirable feeling of hitting and hitting sound to high-grade golfers as well as to beginner golfers and middle-grade golfers.

The present invention will be described hereunder in more detail. In the present invention, metal which is harder than a magnesium alloy and has a greater specific gravity than that of the magnesium alloy is used as a material of the metal head main body. No limitations are imposed on the type of such metal. For instance, a beryllium-copper alloy, stainless steel, carbon steel, maraging steel, a titanium alloy, an aluminum alloy, and the like, can be mentioned.

In relation to hardness, a comparison is performed in terms of a Young's modulus. When compared with a magnesium alloy having a Young's modulus of 50 GPa or less, a beryllium-copper alloy has a Young's modulus of about 130 GPa, stainless steel has a Young's modulus of about 205 GPa; carbon steel has a Young's modulus of about 205 GPa, maraging steel has a Young's modulus of about 186 GPa; an aluminum alloy has a Young's modulus of about 70 GPa; and a titanium alloy has a Young's modulus of about 110 GPa.

In relation to a specific gravity, the specific gravity of a magnesium alloy assumes a value of about 1.8 to 2.0. In contrast, beryllium-copper alloy has a specific gravity of about 8.2; stainless steel has a specific gravity of about 7.8; carbon steel has a specific gravity of about 7.8; maraging steel has a specific gravity of about 8.0; an aluminum alloy has a specific gravity of 2.7; and a titanium alloy has a specific gravity of about 4.5.

In the present invention, no limitations are imposed on the type of a magnesium alloy. An alloy formed by adding aluminum and zinc to magnesium can be preferably used. More specifically, an AZ31 alloy made by adding 3 percent by mass aluminum and 1 percent by mass zinc to magnesium, an AZ61 alloy made by adding 6 percent by mass aluminum and 1 percent by mass zinc to magnesium, an AZ91 alloy made by adding 9 percent by mass aluminum and 1 percent by mass zinc to magnesium, and the like, can be used preferably. However, the magnesium alloy is not limited to them.

Since the magnesium alloy is susceptible to corrosion, the surface of the block of a magnesium alloy may also be subjected to corrosion treatment. Specifically, the surface of the block can be subjected to corrosion treatment by means of chromate treatment, chemical conversion treatment such as selenite treatment, anodizing, and the like, or the surface of the block can be subjected to corrosion treatment by means of coating the surface with insulating coating or an insulation resin.

In the present invention, a block of a magnesium alloy is press-fitted into a recess formed in the metal head main body, and an opening of the recess is sealed with a metal cover, so that the block of a magnesium alloy can be embedded into the metal head main body. The magnesium alloy is very soft and susceptible to deformation, and hence can be readily press-fitted into the recess of the head main body formed from metal which is harder than a magnesium alloy. As a result of the block of a magnesium alloy being press-fitted fixedly into the recess, the block of a magnesium alloy becomes deformed and comes into intimate contact with walls of the recess. Thus, occurrence of a rattle of the block in the recess is prevented.

The size and shape of the recess and the size and shape of the block of a magnesium alloy can be set appropriately. Setting the depth of the recess to 5 to 25 mm, setting to 10 to 20 mm the length of the opening section of the recess from a face to a back, and setting to 20 to 40 mm the length of the opening of the recess from a toe to a heel are preferable. The length of the block of a magnesium alloy from the face to the back and the length of the same from the toe to the heel are appropriately set to a length which enables press-fitting of the block into the recess. Further, the thickness of the block is appropriately set to 4 to 24 mm, particularly 5 to 10 mm. Forming the recess such that the block of the magnesium alloy is placed on the rear of the face is desirable.

The opening of the recess can be provided in, e.g., the face, the sole, and the back. When an opening is formed in the face, the material of the cover can be made identical with that of the head main body, or metal which is harder than the magnesium alloy and has a specific gravity smaller than that of the material of the head main body; for instance, titanium or a titanium alloy, can be employed as the material. Moreover, when an opening is formed in the face as mentioned above, the opening of the recess is formed in the face of the head main body having a sole and a back as in an embodiment to be described later, and a face member can be configured as a cover which seals the opening. When the opening is formed in the sole or the back, a material of the cover can be embodied by metal which is harder than a magnesium alloy and has a specific gravity larger than that of the material of the head main body. For instance, a tungsten alloy (a tungsten-nickel alloy, a tungsten-copper alloy, and the like) can be used. Since the specific gravity of a tungsten alloy ranges from 10 to 14, the centroid of a head can be shifted to a deep or low position by utilization of the weight of the cover.

The length of the cover from the face to the back and the length of the same from the toe to the heel is appropriately set to a length which enables sealing of the opening of the recess, and the thickness of the cover is set to 1 to 2 mm appropriately. In this case, the opening of the recess sealed with the cover may also be made greater than an area in the recess into which a block of a magnesium alloy is to be press-fitted. Further, when the opening of the recess is provided on the sole or the back, setting a distance between the face and the cover to 1.5 to 3.0 mm is preferable.

A method for inserting a cover into the opening of the recess and fixing the cover to the head main body by means of welding, caulking, or the like, can be used as a method for fixing the cover to the head main body. Moreover, as mentioned previously, when the surface of the block of a magnesium alloy has been subjected to corrosion treatment, the block of a magnesium alloy may also be fixed into the recess by means of an adhesive, and the cover may be fixed to the head main body by mean of caulking, to thus enclose the block of a magnesium alloy with the cover.

In the present invention, in the sole of the head main body, a block formed from a material whose specific gravity is larger than that of the material of the head main body, such as a tungsten alloy, can be placed on the toe side and heel side of the block of a magnesium alloy. As a result, the centroid of the head is set to a low position, to thus make it easy to drive a hit ball aloft. A block formed from a material having a large specific gravity is paced on the toe and heel sides of the block of a magnesium alloy. Thus, the moment of inertial achieved along the direction from the toe to the heel can be increased, to thus enlarge a sweet area.

In the present invention, when the opening of the recess is provided in the sole or the back, the head main body can be plated after the cover has been fixed to the head main body by means of welding, caulking, or the like.

According to the iron golf club head of the present invention, high-grade golfers, as well as beginner golfers and middle-grade golfers, can acquire desirable feeling of hitting and desirable hitting sound.

DETAILED DESCRIPTION OF THE EMBODIMENTS

Embodiments of the present invention will be described hereunder by reference to the drawings. However, the present invention is not limited to the following embodiments.

First Embodiment

Figure 1:
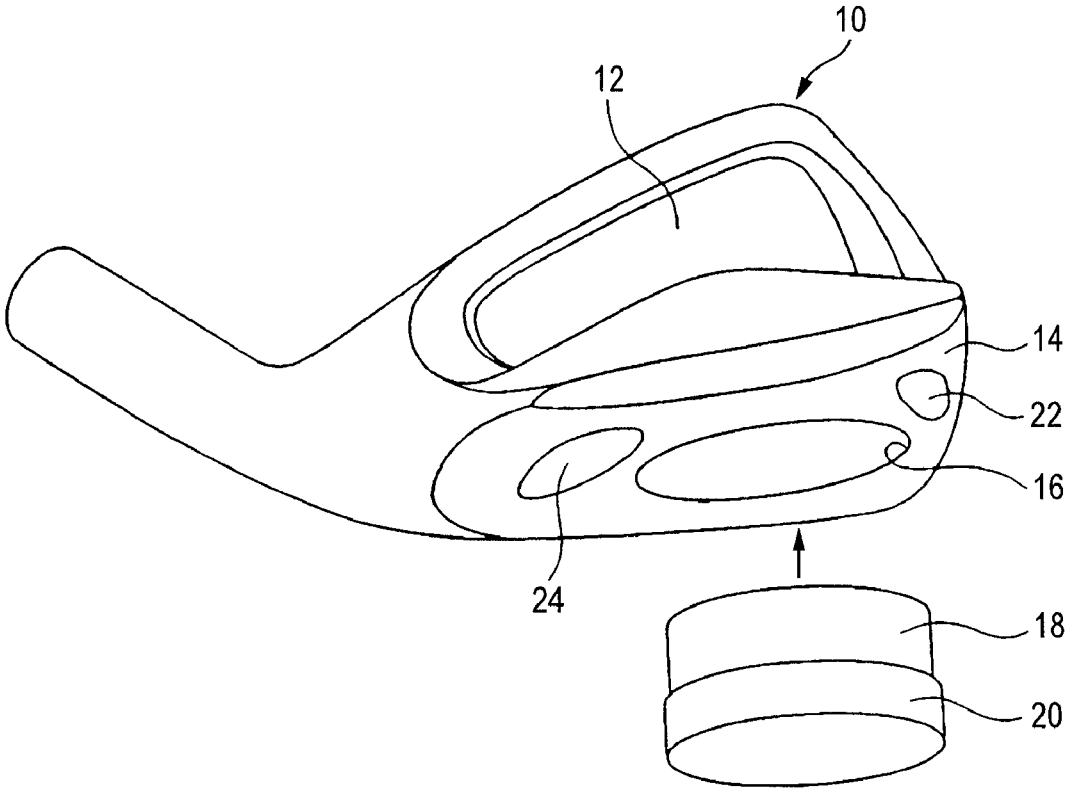
FIG. 1 is a perspective view showing a first embodiment of an iron golf club head of the present invention.
Figure 2:
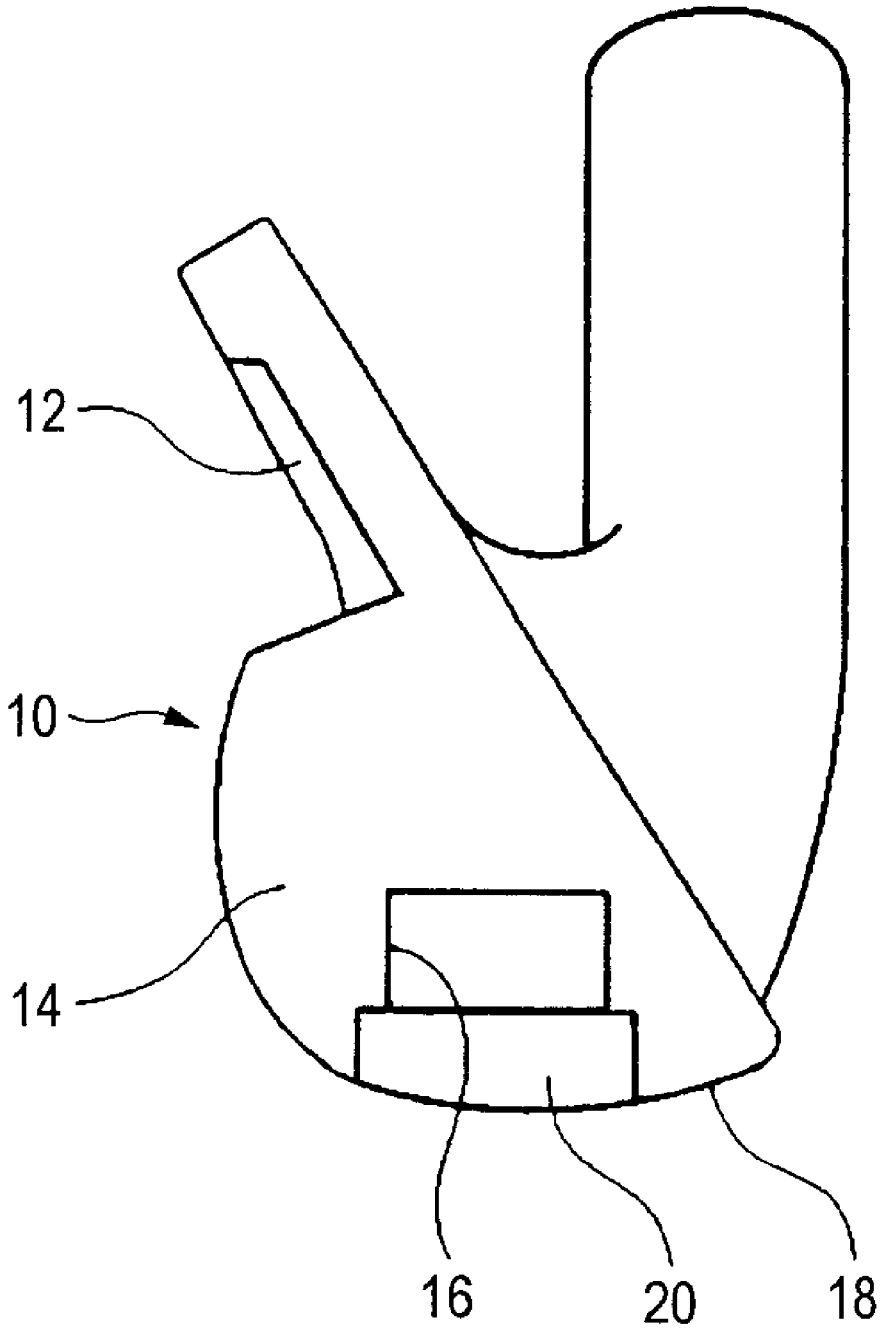
FIG. 2 is a cross-sectional view of the iron golf club head shown in FIG. 1.

FIG. 1 is a perspective view showing a first embodiment of an iron golf club head of the present invention. FIG. 2 is a cross-sectional view of the iron golf club head. In FIGS. 1 and 2, reference numeral 10 designates a metal head main body. The metal head main body 10 has a cavity 12 formed in an upper portion of a back of the main body and a bulging portion 14 which is formed in a lower portion of the back and assumes an essentially-semicircular cross-sectional profile. In the iron golf club head of the embodiment, a recess 16 whose opening section is of an oval shape is formed in a sole surface of the bulging portion 14. A block 18 of a magnesium alloy is press-fitted into the recess 16, and a metal cover 20 is fixed into the opening of the recess 16 by means of welding. Thus, the opening of the recess 16 is sealed with the cover 20. In the iron golf club head of the present embodiment, in order to make the position of the cover 20 stable, the diameter of the opening of the recess 16 sealed with the cover 20 is made slightly larger than the diameter of an area in the recess 16 where the block 18 of a magnesium alloy is to be press-fitted. In the iron golf club head of the present embodiment, blocks 22 and 24 formed from a material, such as a tungsten alloy, whose specific gravity is greater than that of a material of the head main body 10 are embedded into a toe side and a heel side of the recess 16 in the sole of the bulging portion 14 of the head main body 10.

Second Embodiment

Figure 3:
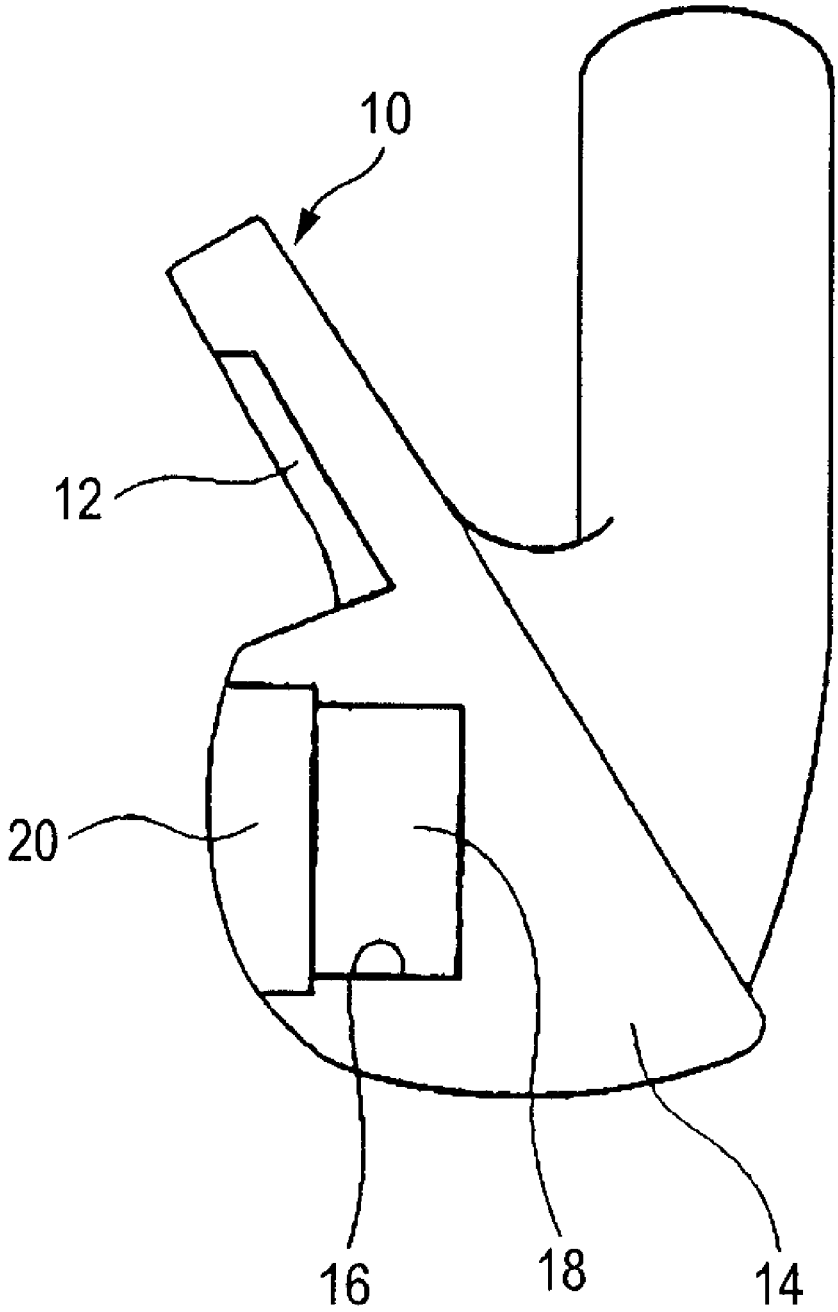
FIG. 3 is a cross-sectional view showing a second embodiment of the iron golf club head of the present invention.

FIG. 3 is a cross-sectional view showing a second embodiment of the iron golf club head of the present invention. In the iron golf club head of the present embodiment, the recess 16 is formed in the back of the bulging portion 14 of the head main body 10 as in the case of the first embodiment. The block 18 of a magnesium alloy is press-fitted into the recess 16. The metal cover 20 is fixed into the opening of the recess 16 by means of welding, whereby the opening section of the recess 16 is sealed with the cover 20. Moreover, in the iron golf club head of the present embodiment, the diameter of the opening of the recess 16, which is to be sealed with the cover 20, is made slightly larger than the diameter of an area of the recess 16 into which the block 18 of a magnesium alloy is to be press-fitted, as in the first embodiment.

Third Embodiment

Figure 4:
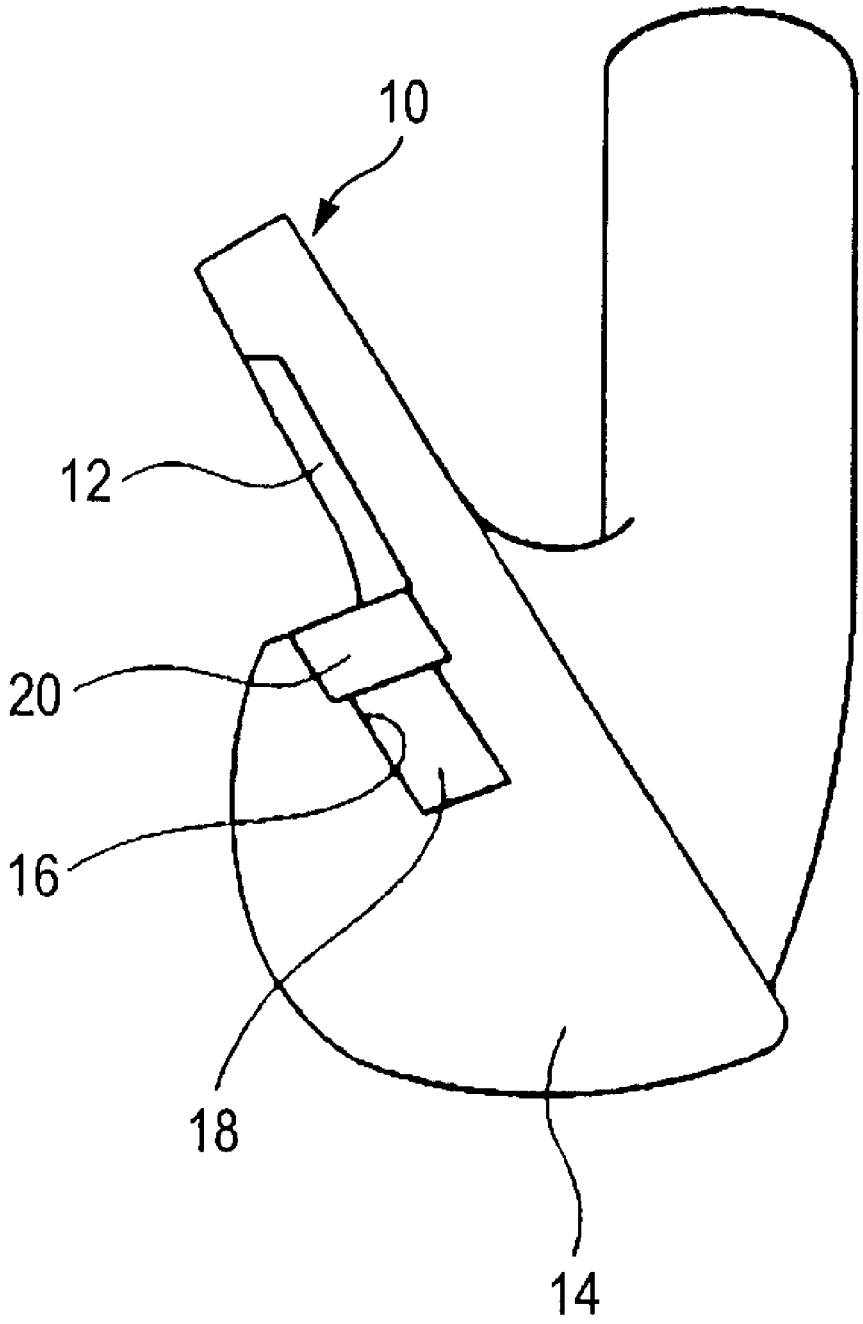
FIG. 4 is a cross-sectional view showing a third embodiment of the iron golf club head of the present invention.

FIG. 4 is a cross-sectional view showing a third embodiment of the iron golf club head of the present invention. In the iron golf club head of the present embodiment, the recess 16 is formed in an upper surface of the bulging portion 14 of the head main body 10, as in the first embodiment. The block 18 of a magnesium alloy is press-fitted into the recess 16. The metal cover 20 is fixed into the opening of the recess 16 by means of welding, whereby the opening section of the recess 16 is sealed with the cover 20. Moreover, in the iron golf club head of the present embodiment, the diameter of the opening of the recess 16, which is to be sealed with the cover 20, is made slightly larger than the diameter of an area of the recess 16 into which the block 18 of a magnesium alloy is to be press-fitted, as in the first embodiment.

Fourth Embodiment

Figure 5:
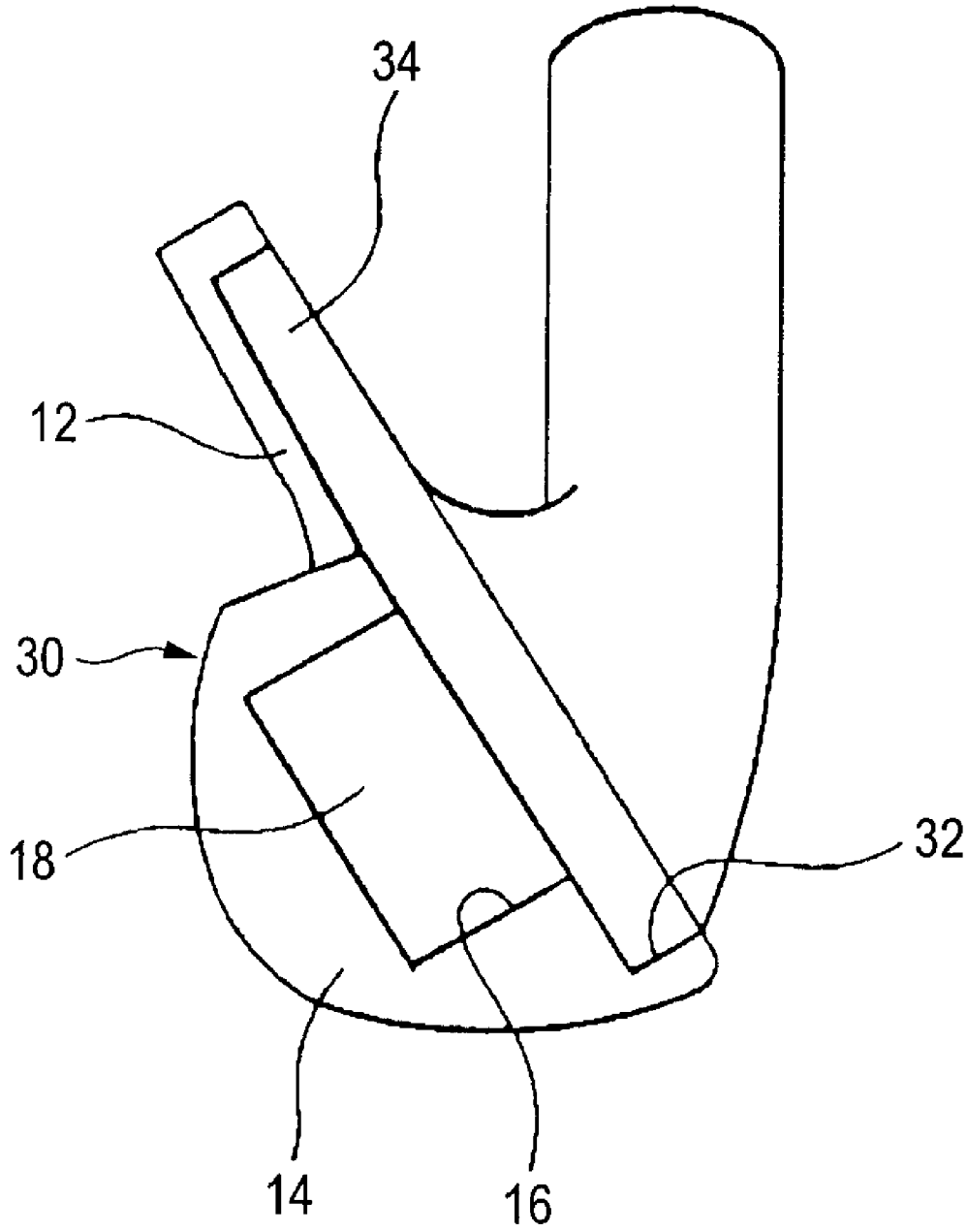
FIG. 5 is a cross-sectional view showing a fourth embodiment of the iron golf club head of the present invention.

FIG. 5 is a cross-sectional view showing a fourth embodiment of the iron golf club head of the present invention. In FIG. 5, reference numeral 30 designates a metal head main body. This metal head main body 30 has the cavity 12 formed in an upper portion of the back, and the bulging portion 14 having an essentially-semicircular cross-sectional profile is provided in a lower portion of the back. A face member insertion recess 32 is provided in the face. In the iron golf club head of the present embodiment, the recess 16 is formed in the face of the bulging portion 14, and the block 18 of a magnesium alloy is press-fitted into the recess 16. A metal face member 34 is fixed in the face member insertion recess 32 by means of caulking, whereby the face member insertion recess 32 is sealed with the face member 34. Specifically, in the present embodiment, the face member insertion recess 32 is provided as the opening of the recess 16 in the face of the head main body 30 having the sole and the back, and the face member 34 is configured as a cover which seals the opening section. In the iron golf club head of the present embodiment, for instance the head main body 30 can be formed from stainless steel, and the face member 34 can be formed from a titanium alloy.

Fifth Embodiment

Figure 6:
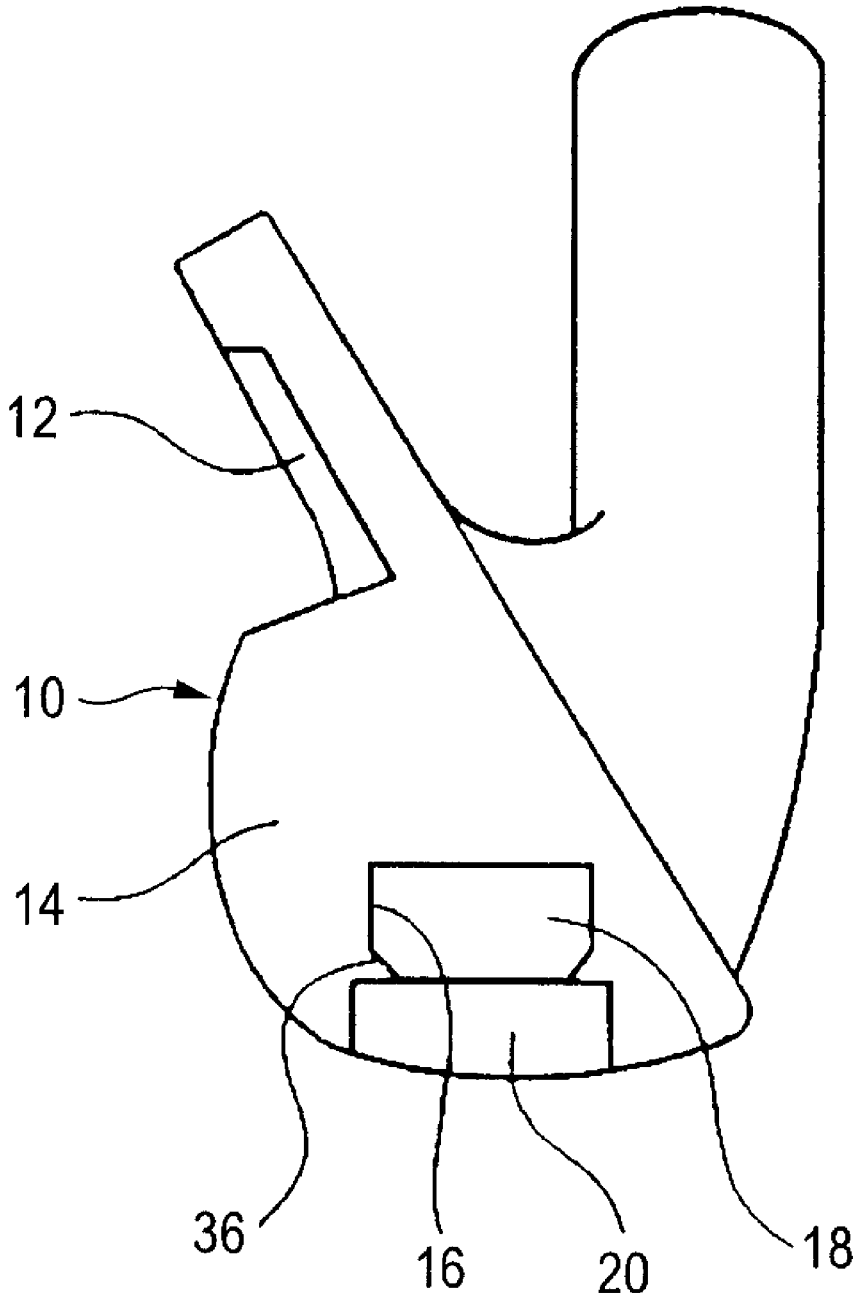
FIG. 6 is a cross-sectional view showing a fifth embodiment of the iron golf club head of the present invention.

FIG. 6 is a cross-sectional view showing a fifth embodiment of an iron golf club head of the present invention. In the iron golf club head of the present embodiment, the recess 16 is formed, as in the first embodiment, in the sole surface of the bulging portion 14 of the head main body 10. The block 18 of a magnesium alloy is fixed to the inside of the recess 16 by means of caulking 36. The metal cover 20 is fixed into the opening of the recess 16 by means of welding, whereby the opening of the recess 16 is sealed with the cover 20. In the iron golf club head of the present embodiment, the diameter of the opening of the recess 16, which is to be sealed with the cover 20, is made slightly larger than the diameter of an area in the recess 16 into which the block 18 of a magnesium alloy is to be press-fitted, as in the first embodiment.

Example

The iron golf club head of the first embodiment shown in FIGS. 1 and 2 will be discussed. In this case, the head main body and the cover are formed from S20C which is carbon steel, by means of forging. The recess into which a magnesium alloy is to be inserted is formed in the sole by means of machining. The opening of the recess to be sealed with a cover is machined to make the position of the cove stable in such a way that the diameter of the opening became slightly larger than the diameter of an area of the recess into which the block of a magnesium alloy is to be press-fitted. The block of a magnesium alloy is formed from an AZ61 alloy by means of stamping. The thickness of the block of a magnesium alloy is 5 mm; the length of the block along the direction from the face to the back is 8.35 mm; and the length of the block along the direction from the toe to the heel is 33 mm. The mass of the block is 2.2 grams. The length of the cover along the direction from the face to the back and the length of the same along the direction from the toe to the heel are made slightly larger than the length of the block of a magnesium alloy. The thickness of the cover is 2 mm. The block of a magnesium alloy is placed in the recess and fixed by means of press-fitting. Subsequently, the cover is fitted into the recess and fixed by means of welding. After welding of the cover, the cover is subjected to abrasion. A substrate of the cover is then plated with nickel, and the surface of the cover is plated with chrome. Thus, the iron golf club head (a five iron) of the present embodiment is completed.

A golf club is manufactured by use of the iron golf club head, and the feeling of hitting is evaluated by means of actual hitting of a ball by a golfer. For the purpose of comparison, similar evaluation is also performed by use of a solid iron golf club head (a five iron, Comparative Example 1) formed solely from carbon steel by means of forging and a hollow iron golf club head (a five iron, Comparative Example 2) having a viscoelastic element provided in a hollow section. Evaluation by the golfer is as follows.

Iron Golf Club Head of the Embodiment

Soft feeling of hitting equal to feeling of hitting achieved by an iron golf club head formed from soft iron by means of forging Secure feeling of hitting, and the feeling of hitting differing from light feeling of hitting such as that generated by a hollow iron golf club head Even when a ball is hit without the meet of the club head, vibration does not shake hands, and comfortable, soft feeling is gained.

Some golfers may evaluate the feeling of hitting as being unclear. However, since comfortable, soft feeling is achieved, the feeling of hitting is preferable for ordinary golfers.

Iron Golf Club Head of Comparative Example 1

Feeling of hitting is soft.

Secure feeling of hitting

A hit point can be securely felt.

When a ball is hit without the meet of the club head, vibration shakes hands.

Iron Golf Club Head of Comparative Example 2

Dull feeling of hitting

Light hitting sound, and feeling of hitting is not gained.

Unsharp feeling of hitting

Vibration does not shake hands, and soft feeling of hitting is gained.

What is claimed is:

1. An iron golf club head comprising:

a block that is made by a magnesium alloy;

a metal head main body, a recess that is formed in the metal head main body; and a face member made by a titanium alloy; wherein:

the block is embedded into the metal head main body;

the block is press-fitted into the recess;

an opening of the recess is sealed with the face member to embed the block into the metal head main body; and the metal head main body has a cavity disposed above the recess at an upper portion of a back of the metal head main body and has a bulge having an essentially semi-circular cross-sectional profile disposed at a lower portion of the back of the metal head main body.

2. The iron golf club head according to claim 1, wherein the magnesium alloy comprises aluminum and zinc.

3. The iron golf club head according to claim 1, wherein the magnesium alloy is one of AZ31, AZ61 or AZ91.

4. The iron golf club head according to claim 1, wherein the magnesium alloy has a Young's modulus of 50 GPa or less, and a specific gravity in the range of 1.8 to 2.0.

5. The iron golf club head according to claim 1, wherein the recess has a depth in the range of 5 and 25 mm, an opening length in the range of 10 to 20 mm in a front-back direction of the club head and an opening length in the range of 20 to 40 mm in a heel toe direction of the club head.

6. The iron golf club head according to claim 1, where the opening of the recess is disposed in a face of the bulge.

7. The iron golf club head according to claim 1, wherein a plurality of tungsten alloy blocks are embedded into the bulge at a toe side of the recess and at a heel side of the recess.

* * * * *